United States Patent [19]

Hilgarth

[11] Patent Number: 4,718,180

[45] Date of Patent: Jan. 12, 1988

[54] SKI BOOT

[75] Inventor: Kurt Hilgarth, Graz, Austria

[73] Assignee: Skischuhfabrik Dynafit Gesellschaft m.b.H., Graz, Austria

[21] Appl. No.: 907,983

[22] Filed: Sep. 16, 1986

[30] Foreign Application Priority Data

Sep. 17, 1985 [AT] Austria ..... 2709/85
Jan. 23, 1986 [AT] Austria ..... 157/86

[51] Int. Cl.[4] ..... A43B 5/04; A43C 11/00

[52] U.S. Cl. ..... 36/117; 36/50; 36/54; 24/68 SK

[58] Field of Search ..... 36/50, 54, 117–121; 24/68 SK, 69 SK, 70 SK, 71 SK

[56] References Cited

U.S. PATENT DOCUMENTS

| | | | |
|---|---|---|---|
| 719,035 | 1/1903 | Paterson | 24/68 SK |
| 3,262,167 | 7/1966 | Martin | 36/50 X |
| 3,668,791 | 6/1972 | Salzman et al. | 36/117 X |
| 3,738,027 | 6/1973 | Schoch | 36/50 |
| 4,282,660 | 8/1981 | Hanson . | |
| 4,308,674 | 1/1982 | Tessaro . | |

FOREIGN PATENT DOCUMENTS

| | | | |
|---|---|---|---|
| 339773 | 11/1977 | Austria . | |
| 343510 | 6/1978 | Austria . | |
| 346732 | 11/1978 | Austria . | |
| 347292 | 12/1978 | Austria . | |
| 368846 | 11/1982 | Austria . | |
| 0123673 | 10/1984 | European Pat. Off. | 36/50 |
| 49242 | 10/1889 | Fed. Rep. of Germany | 24/68 SK |
| 634799 | 9/1936 | Fed. Rep. of Germany | 36/54 |
| 1806109 | 3/1977 | Fed. Rep. of Germany . | |

*Primary Examiner*—James Kee Chi

*Attorney, Agent, or Firm*—Fleit, Jacobson, Cohn & Price

[57] ABSTRACT

A ski boot having a shell and a leg portion (3) which is pivotable in the longitudinal direction relative to said shell. To permit entry into the boot from the rear, the leg portion may comprise a sleeve, which is to surround the front, lower portion of the user's shin bone and is open towards the heel, and a cover which is forwardly-upwardly and rearwardly-downwardly pivotable relative to said sleeve and, when the boot has been put on, the cover is securable on the sleeve by its closing means. The leg portion, or respectively the sleeve, has in its front region at least one slot which extends downwardly from its upper edge. In the instep region of the leg portion (3), this ski boot has two leg portion flaps (18,18') which are interconnected by means of at least one pivot member (**21, 21*a*), so that they are vertically displaced in opposite directions relative to each other. An adjustable pressure or locking member is provided between the leg portion flaps (18, 18') and, in one position, establishes a form- or force-locking connection with the two leg portion flaps (18, 18'**) and, in another position, releases this connection.

8 Claims, 20 Drawing Figures

5
7
9
6
10
20
3
2
19
11
13
4
12
18'
1
18
E
14
E
15
14
21
14
29
18
21
12
13
12
13
18
18'
18'
2
4
4
3
3
2
1

1

21
27
23

21
26
25
27
23

26"
26
26'

24
21

22
23
25

27
XII
XII 28
27

22
23

SKI BOOT

The present invention relates to a ski shoed boot having a casing or sheel and a leg portion which is forwardly and rearwardly pivotable relative to said shell and, for entry into the boot from the rear the leg portion comprises a sleeve, which surrounds the front, lower portion of the shin bone and is open towards the rear, and a cover which is forwardly-upwardly and rearwardly-downwardly pivotable relative to said sleeve and, when the boot has been put on, the cover is securable on the sleeve by a closing means, said sleeve having in its front region at least one slot which extends downwardly from the upper edge of the sleeve.

With a "rear entry boot", there exists the problem that, by closing the cover, a pressure is exerted upon the unsymmetrical shin bone which is normally outwardly displaced relative to the central plane of the foot lying in the direction of travel, such a pressure pressing the leg into a central location in which the leg occupies an X position. To compensate for this phenomenon, when the skier crouches or squats during normal skiing, he is inclined to load only the outer edges of the skis and to raise the inner edges thereof. In particular, this is detrimental to the unskilled skier when negotiating a bend or turning, during an snowplough movement and especially during pivotal movement.

The present invention seeks to provide measures whereby, when the cover is closed, the leg portion and the sleeve comply with the anatomically correct position and form of the shin bone. With a ski boot of the above-mentioned type, this object is achieved according to the invention, in that two flaps are provided to keep the sleeve portions together, such flaps surrounding the upper region of the sleeve and being pivotally interconnected so that the flaps are adjusted or displaced in opposite directions to each other by the movements of the foot.

According to a further feature of the invention, a slot is additionally provided in the longitudinal centre of the sleeve. This additional slot may be shorter and wider than the two lateral slots, so that two portions are produced which are mirror-inverted relative to the longitudinal central plane of the ski boot and permit the sleeve to be adapted to the anatomical form of the shin bone in a very precise manner, even if there are some irregularities.

The arrangement for keeping the sleeve portions together is advantageously securable in the reciprocal position of the sleeve portions resulting after the cover has been closed.

Finally, it is an object of the invention that, in order to keep the sleeve portions together, two flaps are provided which surround the upper region of the sleeve and extend from the two sides of the sleeve, such flaps being pivotally connected at their free ends.

SUMMARY OF INVENTION

A ski boot having a casing or shell portion and a leg portion which, in the direction of movement of the shoe, is pivotable about an axis perpendicular to said direction of travel and comprises a cuff or sleeve, which surrounds the front, lower portion of the shin bone, and a cover which is mounted opposite said sleeve so as to be pivotable about an axis perpendicular to the direction of travel and is connectable to the sleeve of the boot by a closing means.

The sleeve is provided with slots in the front, central region over a portion of its height, extending from the upper edge downwardly, and has two flaps which are displaceable in opposite directions, said flaps being conected by means of pivot or guide members and being securable in any position.

The invention will be described further, by way of example, with reference to the accompanying drawings, in which.

Figures 5, 6, 7, 8, 9, 10, 11, 12, 13:
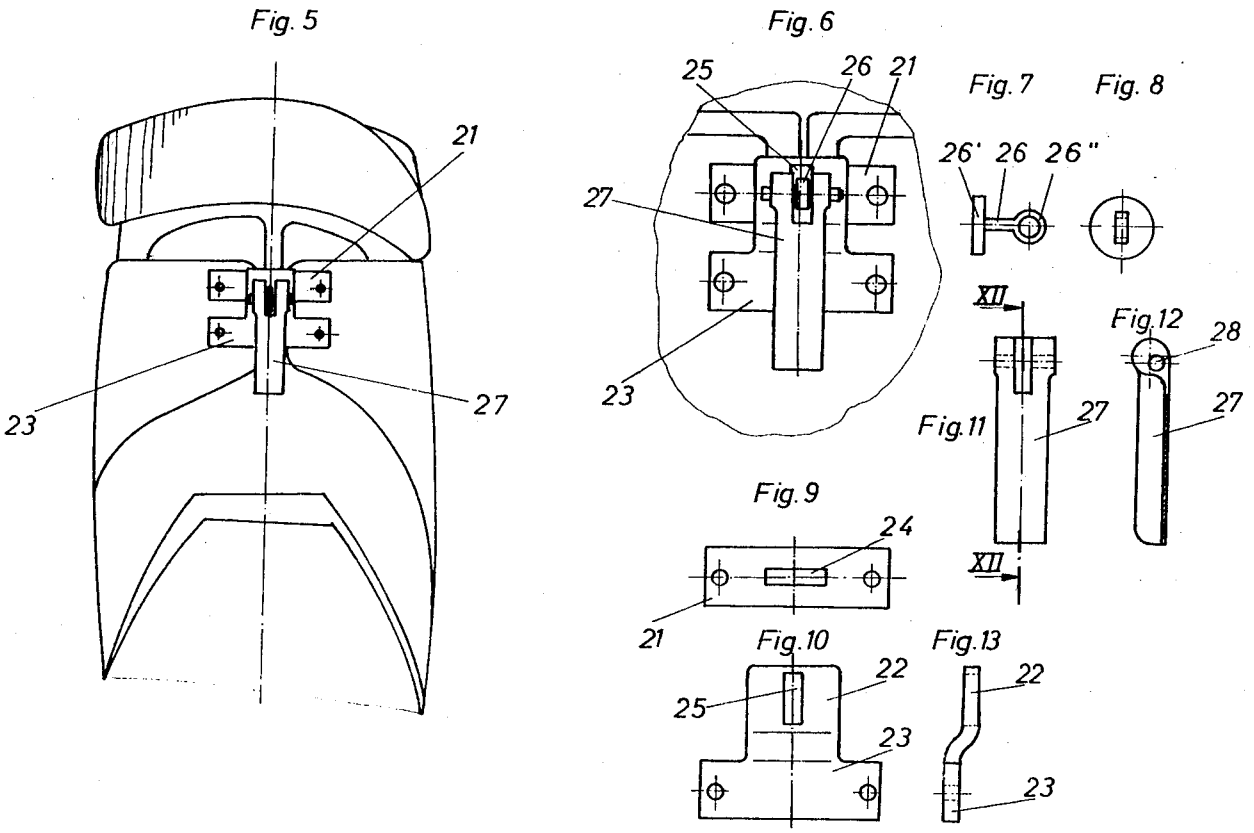
FIG. 5 is a front view of an additional embodiment of the ski boot.
FIGS. 6 to 13 illustrate details of the embodiment shown in FIG. 5.
Figure 15:
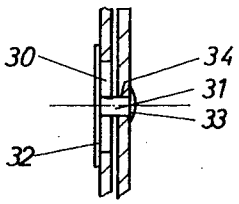
Figure 14:
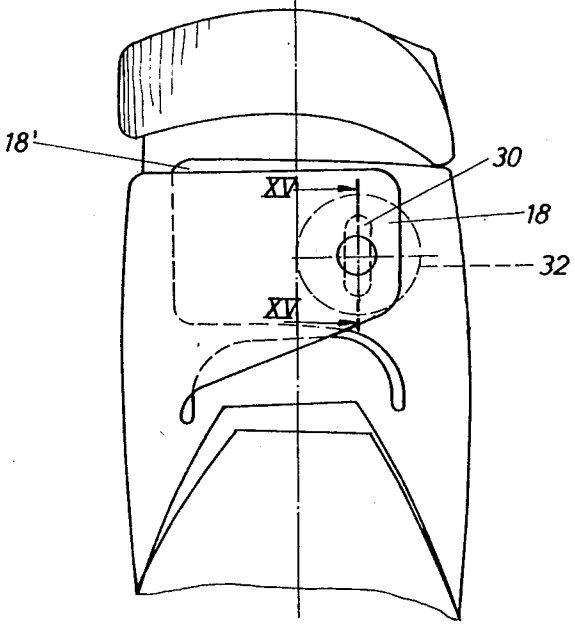
Figure 16:
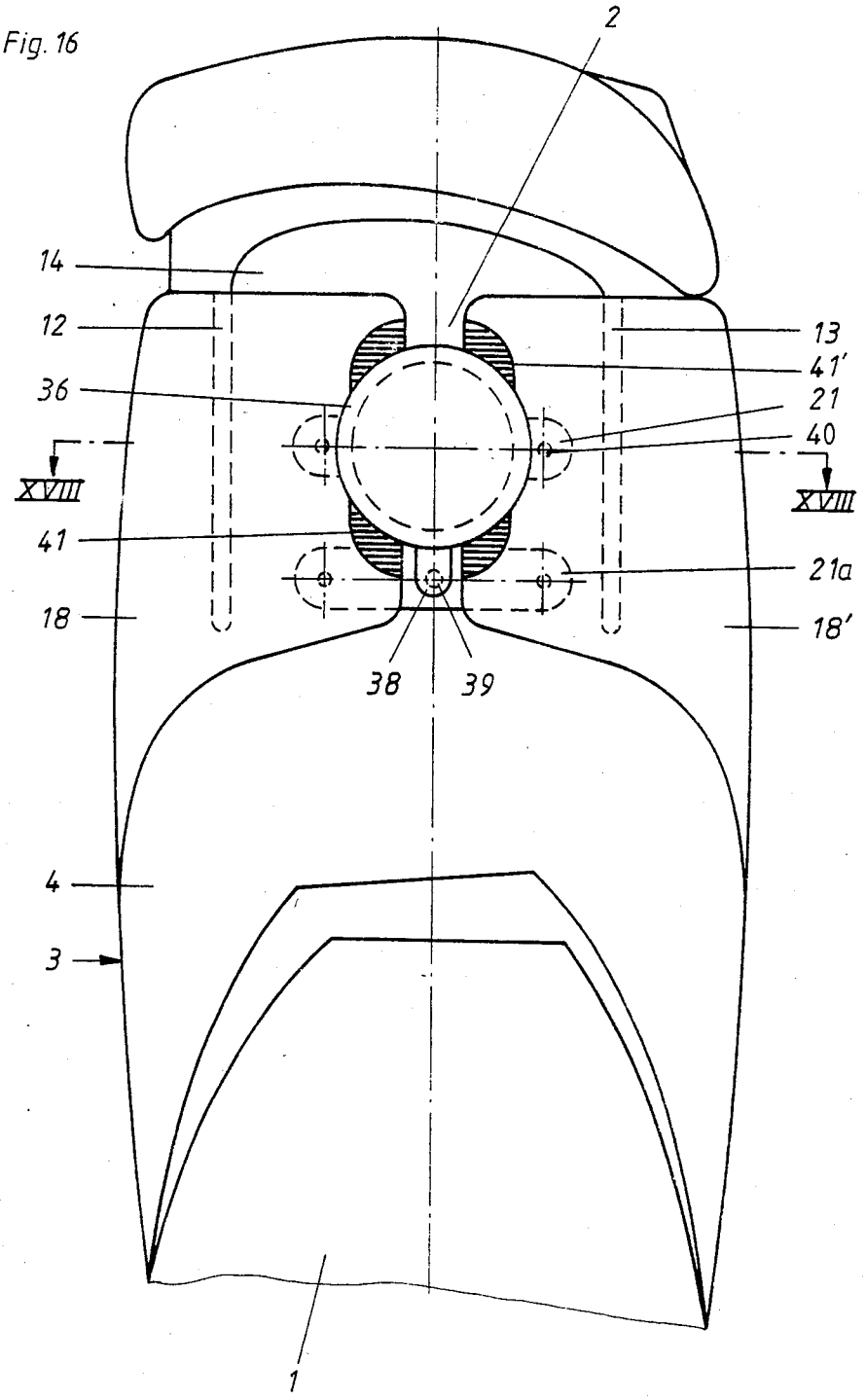
Figure 17:
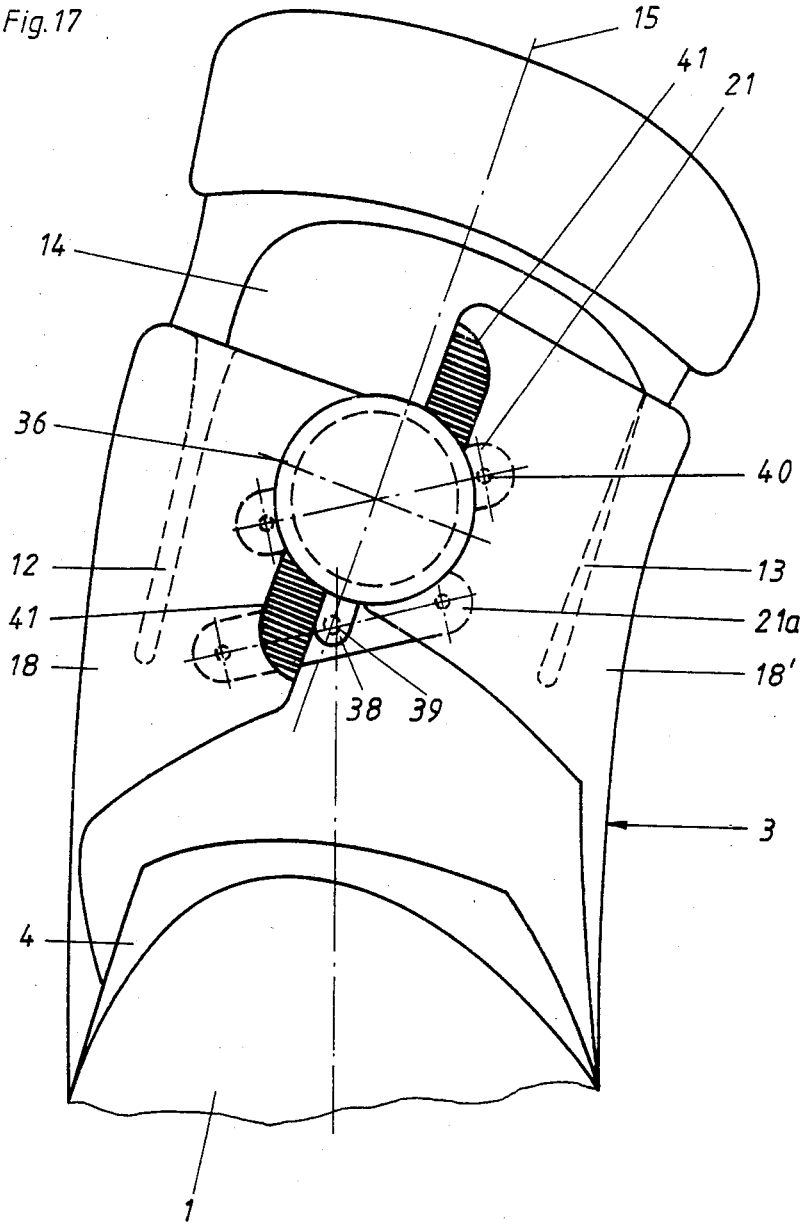
Figure 18:
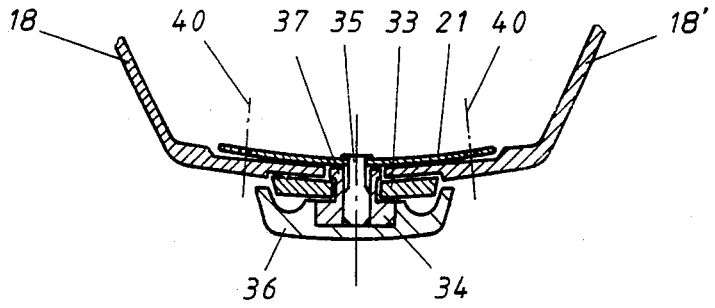
Figure 19:
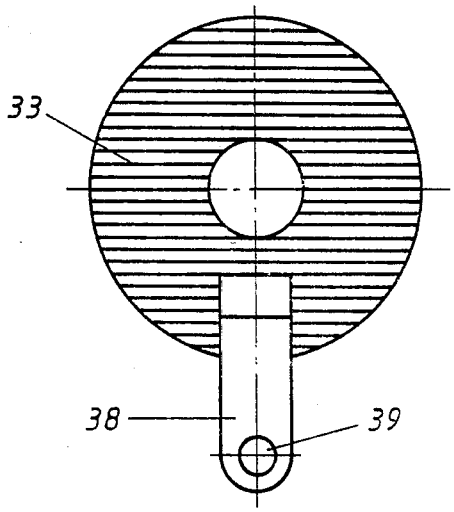

FIG. 12 being a sectional view taken along the line XII—XII of FIG. 11;

FIG. 14 illustrates an additional embodiment of the ski boot;

FIG. 15 is a sectional view taken along the line XV—XV of FIG. 14;

FIG. 16 is a front view of the ski boot, wherein the shaft/leg portion flaps are in the/their central position, a portion of the shoe shell having been removed;

FIG. 17 illustrates the ski boot with displaced leg portion flaps in the position of use;

FIG. 18 is a sectional view, taken along the line XVIII—XVIII of FIG. 16, through the leg portion flaps and the securing mechanism;

FIG. 19 is a plan view of the toothed plate; and

Figure 20:
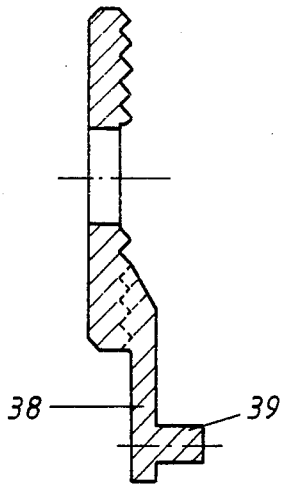

FIG. 20 is a lateral view of the toothed plate.

The ski boot which has been selected as an embodiment is provided with an entry at the heel end and comprises a casing or shell 1 and a shaft or leg portion 3 which is forwardly and rearwardly pivotable relative to said shell 1 and has, in the present case, a sleeve 4 at the instep end and a cover 5 at the heel end, such a cover 5 being preferably pivotable mounted on said sleeve and being connectable, in the position of use, to the sleeve 4 by a closing means, e.g. in the form of a tensioning belt. An inner boot portion or shoe 6 is inserted into the ski boot and has a heel portion 7 which is pivotable together with the cover 5. When the boot has been put on, the cover 5 is retained on the sleeve 4 by means of the tensioning belt, one end of which belt can be mounted on one of the lateral walls of the leg portion 3 and the other end can be adjustably secured to the other wall of the leg portion 3. With conventional ski boots, the user's leg denoted by 9 in section in FIG. 2 is clamped in position in such a manner that the shin bone 10 is displaced from the longitudinal central plane E towards the inside of the boot, so that a gap 11 is produced on the outside of the central plane E, but this gap is to be eliminated by the measures proposed by the present invention.

For this purpose, the sleeve 4 is provided on each side of the longitudinal central plane E, at a distance therefrom, with a respective slot 12, 13 which extends from the upper edge of the sleeve 4 over a portion of its height. This produces a section 14 which, as FIG. 3 shows, may be adapted to the shin bone axis—indicated by the dash-dot line 15—and consequently compensates for the gap 11, so that the inner shoe 6 completely abuts against the leg of the skier. To keep the section 14 and the other portions of the sleeve together during downhill travel, i.e. when the skier has bent his knees, flaps 18 and 18' are used which, just like the sleeve 4, may be formed from plastics material, and such flaps extend from the later walls 19 and 20 of the sleeve 4 beyond the slots 12 and 13, e.g. the flaps are mounted at the location where the tightening belt is also attached. In the present case, the two leg portion flaps 18 and 18' are in the central position so as to be mirror-inverted relative to the longitudinal central plane, a gap 2 existing between the two flaps 18, 18'. These flaps extend substantially along the upper edge of the sleeve 4 and are interconnected at their free ends by means of a guide or pivot member 21 so that, when one flap is forced upwardly, the other has to move downwardly, and vice versa (cf, FIG. 3). The pivot member 21 bridges the gap between the two free ends of the flaps 18, 18' and is pivotally connected to each of them. Although the two flaps in the present case are independent components parts which are connected to the sleeve 4, it is possible to extrude these components parts integral with the lateral walls 19 and 20 of the sleeve 4.

Figures 1, 2, 3:
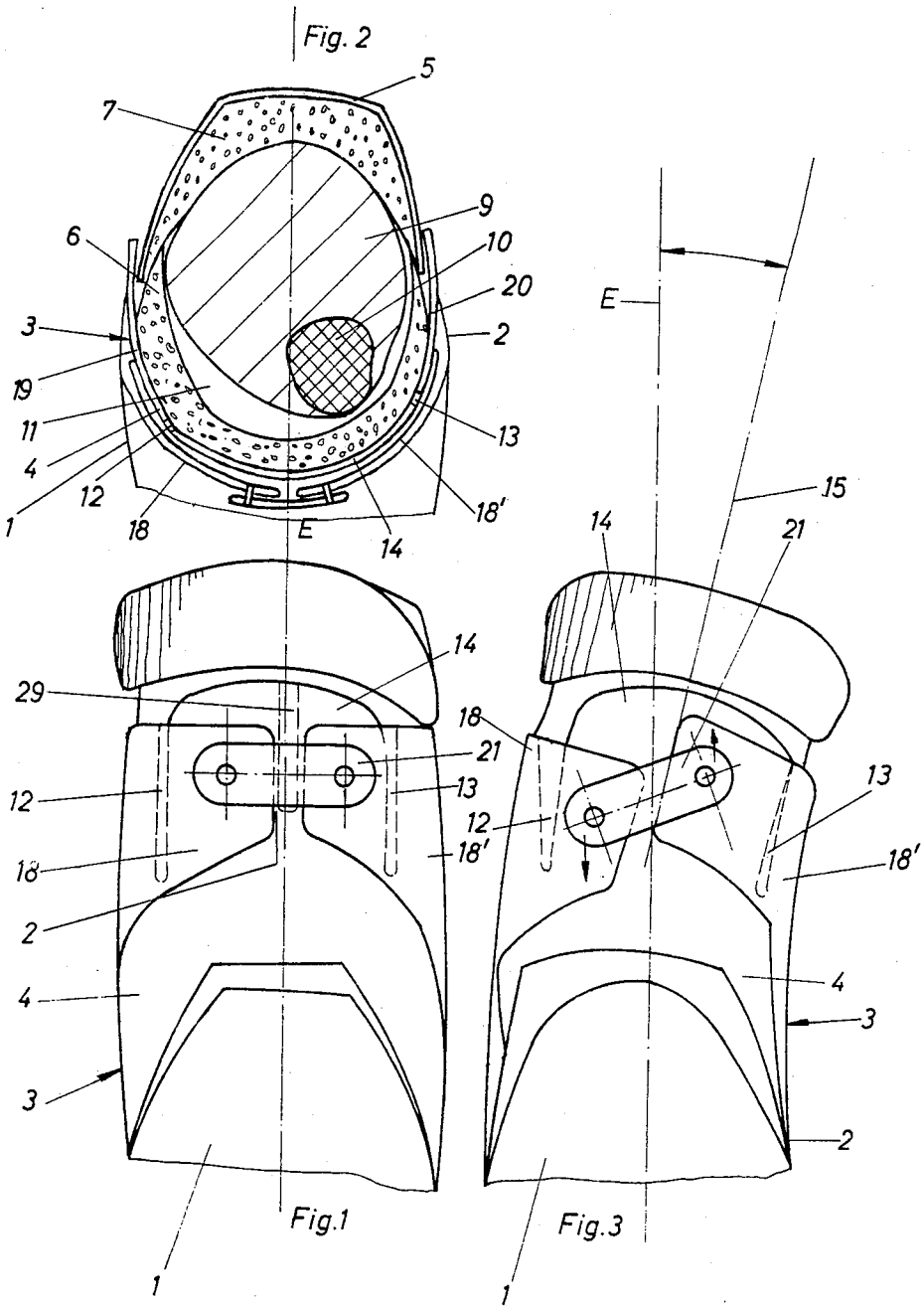
FIGS. 1 and 2 are, respectively, a front view and a plan view of part of a ski shoe or boot showing the cover in its inwardly pivoted position but before the cover has been clamped to the sleeve.
FIG. 3 illustrates the boot after the cover has been clamped to the sleeve.

As shown by dotted lines in FIG. 1, the second 14 may be divided centrally into two portions by means of an additional slot 29 which is preferably shorter than the slots 12 and 13. This measure ensures a better adaptability for the inner shoe—especially if there are irregularities in the leg.

Because of the measures according to the invention, the sleeve 4 is displaced above the ankle, as shown in FIG. 3, and consequently adapts to the anatomically correct position and form of the shin bone after the cover 5 has been closed. This position of the sleeve 4 may be secured by an arrangement which is shown in FIGS. 6 to 13, in that the pivot member 21 is secured, for example, in this position.

Upon displacement of the flaps 18 and 18', the pressure exerted upon the leg is increased by the upwardly moving flaps, whereas the pressure exerted by the downwardly moving flaps is reduced. Consequently, the ski is uniformly loaded over its entire width, with the result that the ski can also be guided well.

Figure 4:
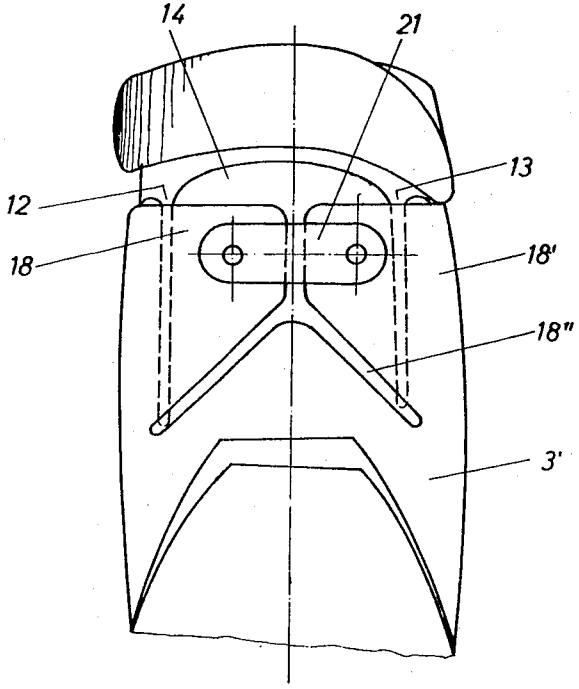
FIG. 4 is a front view of an additional embodiment of the ski boot.

In the embodiment shown in FIG. 4, the two flaps 18 and 18' are component parts of an extension portion 3' of the shoe leg portion, which extension portion 3' surrounds at least the front portion of the sleeve; the flaps 18 and 18' are separated from the above-mentioned extension portion 3' by means of a slot 18" which corresponds in shape to an inverted "Y"

In the embodiment of the ski shoe shown in FIG. 5, the pivot member 21 is covered by the arm 22 of a crosspiece member 23 which is situated lower down, a transverse slot 24 being provided in the pivot member 21 and longitudinal slot 25 being provided in the arm 22. A pin 26 is passed through both slots, such pin extending from a pressure plate 26' having an eyelet 26" at its free end. A journal 28 passes through the eyelet 26" and eccentrically penetrates the cylindrical, forked end of a tightening or tensioning lever 27 which acts as an eccentric lever.

Due to the arrangement whereby the two slots 24 and 25 extend perpendicular to one another and lie one above the other in the pivot member 21 and extension member 22, respectively, these components parts are freely displaceable relative to one another upon the reciprocal displacement of the flaps 18 and 18' as long as the tensioning lever 27 is raised. If, however, the lever 27 is pressed towards the shoe, the pressure plate is drawn towards the pivot member 21 and the forked end of the lever 27 presses against the extension member 22. The pivot member 21 and the crosspiece member 23 are secured relative to one another by means of frictional forces, and the sleeve can no longer be displaced.

The skier climbs into the shoe, closes the cover 5 and bends his knees so that he adopts the downhill travelling position; this causes the lever 27 to be opened, i.e. pivoted away from the shoe, so that the sleeve can adopt the position shown in FIG. 3. Thereafter, the lever 27 is pressed against the boot so that the eccentric secures the crosspiece member 23 in the position presented by the leg, as mentioned above. Consequently, the skier has a firm support in the shoe an hence achieves good guidance for the ski. As soon as the downhill travel has finished, the skier can adopt a more confortable position in the shoe by opening the lever 27.

Finally, it is possible also to omit the flaps 18 and 18' and to attach the pivot member 21 directly to the slotted sleeve. Instead of using the eccentric means which has been described, it is also possible to use any other securing means.

According to FIG. 14, the two flaps 18 and 18' lie with their free ends one above the other. The end of the flap 18', which lies underneath in this case, is provided with a slot 30 which extends in a straight line or possibly in a curve and substantially extends downwardly from above. This slot is pierced or passes through by a pin 31 which is secured, at one end, to a pressure plate 32 and pierces or passes through a bore 34 in the free end of the upper flap 18' whilst its other end has a wide head 33.

In the embodiment, pivot member 21 or pivot member **21*a* and crosspiece member 23 are replaced by the slot 30 and the pin 31** which have the same function of holding the flaps together.

By applying a thread instead of the head 33, onto which thread a knurled nut is possibly screw-mounted, it is also possible here to achieve the reciprocal securement of the flaps 18 and 18' by means of frictional forces.

In the arrangement of the ski boot as shown in FIGS. 16 to 20, the two leg portion flaps 18 and 18' are connected by means of two pivot members 21 and **21*a* which are disposed at a vertical spacing from each other, the upper pivot member 21 being disposed at approximately the vertical centre of the two leg portion flaps 18 and 18'. The two pivot members 21 and 21*a* are pivotally connected at their ends to the leg portion flaps 18 and 18' by means of rivets 40**, for example.

In the gap 2, a threaded bolt 35 (FIG. 18) is provided which is non-rotatably riveted with its inner end in the upper connecting pivot member 21 and supports an adjustment nut 34 which is non-rotatably pressed into a securing knob 36. A round, toothed plate 33 is detachable mounted on the adjustment nut 34 and is prevented from becoming detached by means of a collar 37 or the like. As can be seen from FIGS. 4 and 5, the toothed plate 33 is provided in its lower portion with a lug 38 which extends downwardly in the longitudinal central plane and, at its lower end, has a journal 39 which is rotatably mounted in the lower connecting pivot member **21*a* (FIGS. 16 and 17**).

Along each of their edges facing the gap 2, the two leg portions 18 and 18' have a toothed profile 41 and 41', respectively, which corresponds to the toothed profile of the toothed plate 33 and can be brought into engagement with said profile, as will be described more fully hereinafter.

Before the skier steps into the ski boot, the lock knob 36 is unscrewed with its adjustment nut 34 on the threaded bolt 35 until the toothed plate 33 disengages from the toothed profiles 41 and 41'.

Once the skier has stepped into the ski boot, he presses the sleeve laterally as a result of the irregularities of the leg, as shown in FIG. 17, so that the flaps 18 and 18' are displaced in opposite directions. This measure causes one slot—in the present case slot 13—to be compressed and the other slot—in this case slot 12—to be enlarged.

Consequently, the flap 14—formed between slots 12 and 13—is displaced laterally and the entire boot adapts to the form of the leg, so that the leg is supported firmly and comfortably in the shoe. When the ski boot is in this position, the locking knob 36 is rotated until the toothed plate 33 engages with the two toothed profiles 41 and 41', whereby the boot is secured in the position set by the foot.

I claim:

1. A ski boot having a casing and a leg portion which is forwardly and rearwardly pivotable to said casing and, for entry into the boot from the rear, the leg portion comprises a sleeve, which surround the front, lower portion of the shin bone and is open towards the rear, and a cover which is forwardly-upwardly and rearwardly-downwardly pivotable relative to said sleeve and, when the boot has been put on, the cover is securable on the sleeve by a closing means, said sleeve having a front region with a least one slot which extends downwardly from an upper edge of the sleeve so as to define adjacent sleeve portions separated by the slot, characterized in that two flaps are provided on the sleeve to keep the sleeve portions together, such flaps surrounding said region of the sleeve and being pivotally interconnected by means of a pivot member which is pivotally connected to each of the flaps about an axis perpendicular to the plane of the flap so that the flaps are displaced in opposite directions to each other by movements of the foot.

2. A ski boot according to claim 1 wherein for locking the flaps in a selected position, a crosspiece member provided with a central extension portion extends parallel to the pivot member and is connected between the flaps so that the extension portion covers the central portion of the pivot member, and wherein a device is provided with a releasable locking lever on a fitting connected between the pivot member and the extension portion for the frictional compression of the pivot member and extension portion.

3. A ski boot according to claim 1, wherein the sleeve has at least two slots which are substantially mirror-inverted relative to the longitudinal central plane of the shoe.

4. A ski boot according to claim 1, wherein means are provided which serve to secure the leg portion flaps in a position set by the position of the foot after closure of the shoe, said means having a securing knob and an adjustable pressure member which is provided between the flaps so that the pressure member in one position, establishes a locking connection with the flaps and in another position, releases this connection.

5. A ski boot according to claim 4, wherein said knob is adjustable substantially perpendicular to the pressure member and has a locking emmber which co-operates with a counter-locking member for the flaps.

6. A ski boot according to claim 4, wherein said knob is rotatably mounted on a threaded bolt by means of a nut which is secured in said knob and supports a toothed plate which is engageable with a toothed profile of the flaps.

7. A ski boot according to claim 6, wherein the toothed plate is detachably mounted on the nut, and the toothed plate extends over/beyond both toothed profiles of the flaps.

8. A ski boot according to claim 1, wherein said pivot member is connected, via the intermediary of a lug, to means for securing said flaps in a position which they adopt.

* * * * *